US010411395B1

(12) United States Patent
Wu

(10) Patent No.: US 10,411,395 B1
(45) Date of Patent: Sep. 10, 2019

(54) CONNECTOR MODULE WITH LATCH STRUCTURE

(71) Applicants: DINKLE ENTERPRISE CO., LTD., New Taipei (TW); DINKLE ELECTRIC MACHINERY (CHINA) CO., LTD., Kunshan, Jiangsu (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Kunshan, Jiangsu (CN)

( * ) Notice: Subject to any disclaimer, the term of this patent is extended or adjusted under 35 U.S.C. 154(b) by 0 days.

(21) Appl. No.: 16/164,723

(22) Filed: Oct. 18, 2018

(51) Int. Cl.
*H01R 13/506* (2006.01)
*H01R 9/24* (2006.01)

(52) U.S. Cl.
CPC ..... *H01R 13/506* (2013.01); *H01R 9/24* (2013.01)

(58) Field of Classification Search
CPC ..... H01R 13/506
USPC ..... 439/722
See application file for complete search history.

(56) References Cited

U.S. PATENT DOCUMENTS 6,155,886 A * 12/2000 Koseki ..... B29C 45/14639 439/736
6,293,826 B1 * 9/2001 Shi ..... H01R 12/721 439/607.01
6,363,607 B1 * 4/2002 Chen ..... H01R 43/24 29/882
6,902,442 B2 * 6/2005 Huang ..... H01R 12/716 29/883
8,968,016 B1 * 3/2015 Wu ..... H01R 25/14 439/214
9,197,017 B2 * 11/2015 Wu ..... H01R 13/62966
9,620,912 B2 * 4/2017 Wu ..... H01R 12/721
9,801,296 B1 * 10/2017 Wu ..... H05K 5/0221
(Continued)

FOREIGN PATENT DOCUMENTS

DE 10331441 A1 2/2005
DE 102013111577 A1 4/2015
WO 2004114466 A1 12/2004

OTHER PUBLICATIONS

Search Report dated Mar. 27, 2019 of the corresponding European patent application.

*Primary Examiner* — Tulsidas C Patel
*Assistant Examiner* — Peter G Leigh
(74) *Attorney, Agent, or Firm* — Chun-Ming Shih; HDLS IPR Services

(57) ABSTRACT

A connector module with a latch structure includes a base (10), a terminal block (20) and latch structures (30). The base (10) includes a housing (11) having an accommodating space (A), and the incommoding space (A) includes a positioning member (113). The terminal block (20) inserted into the accommodating space (A) includes an insertion main body (21) and conductive terminals (22). Each latch structure (30) is arranged between the housing (11) and the insertion main body (21), which includes a latch portion (31) formed on the insertion main body (21) and a locking member (32) rotatably connected to the housing (11) on one side of the positioning member (113). The locking member (32) includes a locking portion (322) for locking onto the latch portion (31) and locking slots (324) provided for the positioning member (113). Accordingly, the terminal block can be removed without the use of any tools.

11 Claims, 8 Drawing Sheets

(56) References Cited

U.S. PATENT DOCUMENTS

| | | | | |
|---|---|---|---|---|
| 2013/0341083 | A1 | 12/2013 | Binner | |
| 2018/0206351 | A1* | 7/2018 | Wu | H05K 5/0221 |
| 2019/0027866 | A1* | 1/2019 | Wu | H01R 13/6335 |

* cited by examiner

CONNECTOR MODULE WITH LATCH STRUCTURE

BACKGROUND OF THE INVENTION

Field of the Invention

The present invention is related to the technology of a connector module, in particular, to a connector module with a latch structure.

Description of Related Art

For a known traditional connector module, it mainly comprises a base and a plurality of terminal holes arranged inside the base. Each of the terminal holes is provided for each conductive terminal of another connector for insertion therein respectively in order to be used for signal or power transmission.

In case where there is an error in the signal or power transmission in the aforementioned connector, such as: an error occurs in one of the terminal hole such that there is a need for repair, typically, it is necessary to submit the entire connector module for inspection and repair. In addition, if any one of the conductive terminals in the aforementioned connector is damaged, then the entire connector needs to be discarded. This is not only a waste of material and may cause environmental pollution, which is also one of the main causes that the cost of such device remains high.

Furthermore, in another known connector module, the terminal holes are arranged on a terminal block, and the terminal block is fastened onto the base via the use of screws such that detachable mechanism can be achieved. However, despite that the terminal block can be removed from the base in order to perform repair or discard a portion of the parts thereof, during the removal of the terminal block, it is still necessary to use hand tool to unfasten the screws one by one such that the terminal block can be removed. This can be tedious and inconvenient to inspection and repair operation of the device.

In view of above, the inventor seeks to overcome the aforementioned drawbacks associated with the currently existing technology after years of research and development along with the utilization of academic theories, which is also the objective of the development of the present invention.

SUMMARY OF THE INVENTION

An objective of the present invention is to provide a connector module with a latch structure, which requires no additional use of tools during the removal of the terminal block such that the convenience of use of the device is improved.

To achieve the aforementioned objective, the present invention provides a connector module with a latch structure, comprising a base, a terminal block and a pair of latch structures. The base comprises a housing. The housing includes an accommodating space arranged therein, and the accommodating space includes two sides arranged with a positioning member thereon respectively. The terminal block is inserted into the accommodating space correspondingly. The terminal block comprises an insertion main body and a plurality of conductive terminals arranged on the insertion main body. Each one of the latch structures is respectively arranged between the housing and the insertion main body, and each one of the latch structures comprises a latch portion formed on the insertion main body and a locking member rotatably connected to the housing and formed on one side of the positioning member. The locking member includes a locking portion configured to lock onto the latch portion correspondingly and at least one locking slot provided for the positioning member to be positioned thereon.

The present invention further achieves the following technical effects. It allows the terminal block to be removed from the base via the pull handles directly such that the repair or electrical connection operation is facilitated. After the terminal block is removed from the base, the insertion shaft is secured inside the first locking slot for positioning; therefore, each locking member is under an inverted opening state, facilitating the terminal block to be inserted therein successfully during the next time of assembly.

DETAILED DESCRIPTION OF THE INVENTION

Figure 1:
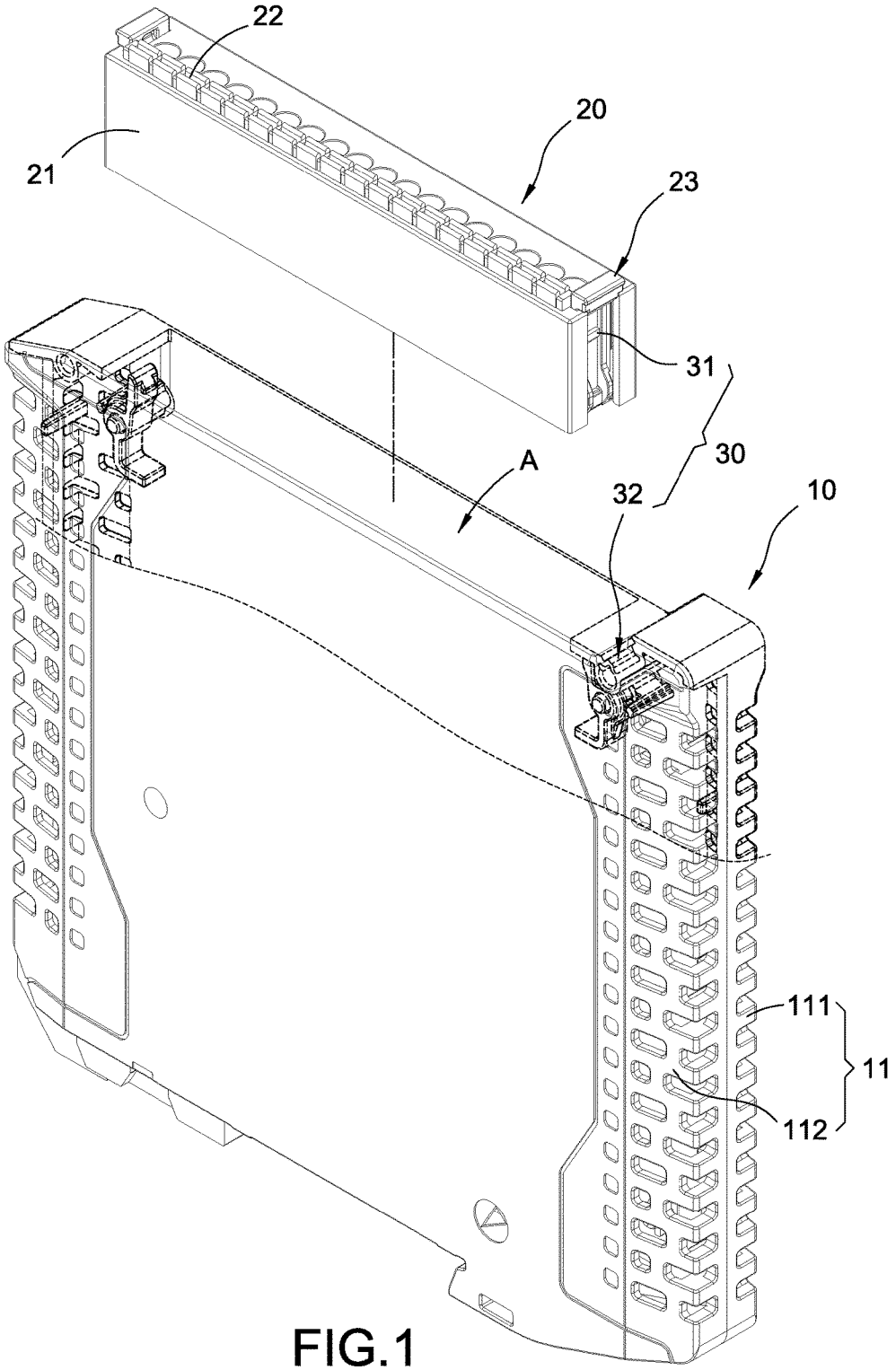
FIG. 1 is a perspective exploded view of the connector module of the present invention.
Figure 2:
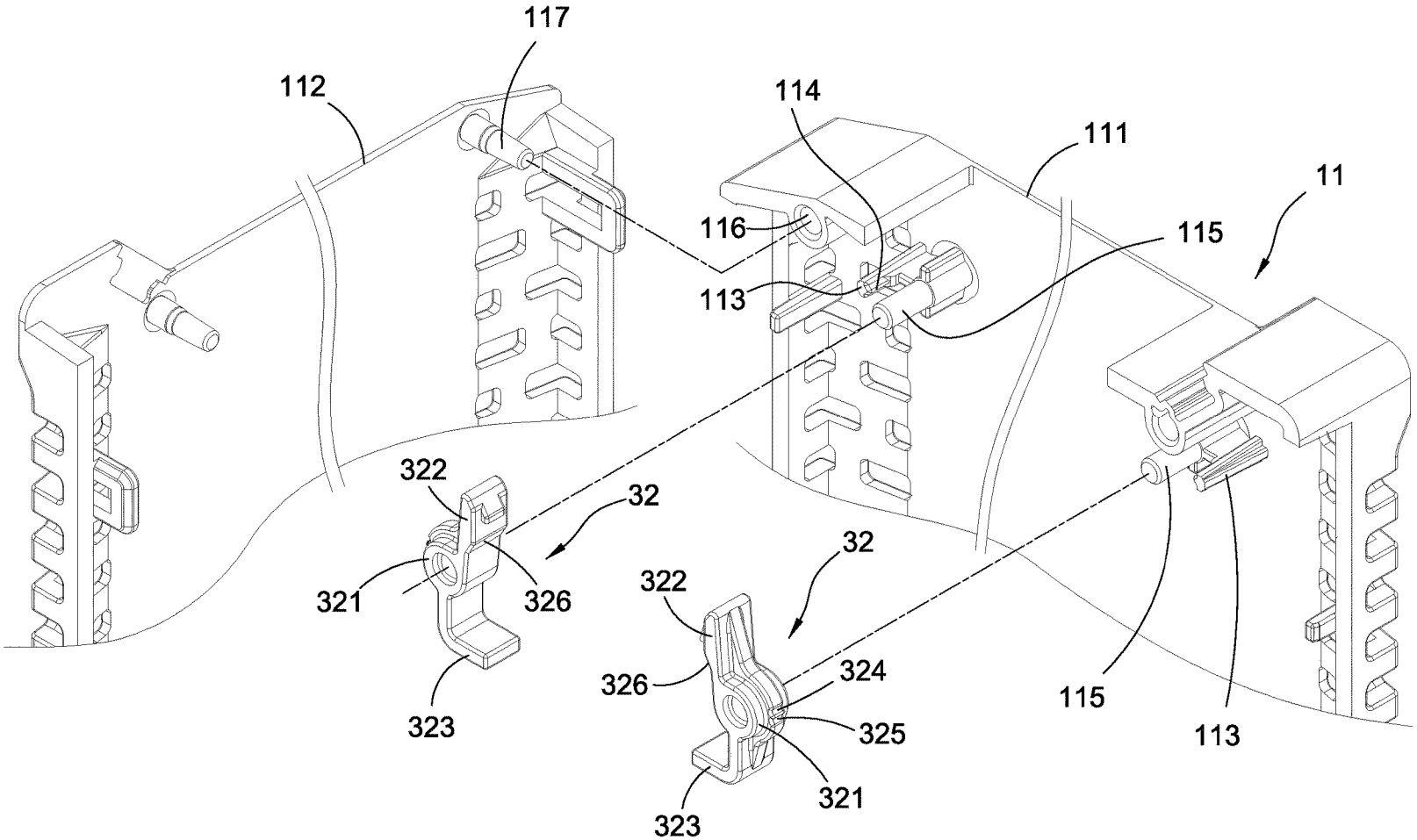
FIG. 2 is a perspective exploded view of the housing and the locking member of the present invention.
Figure 3:
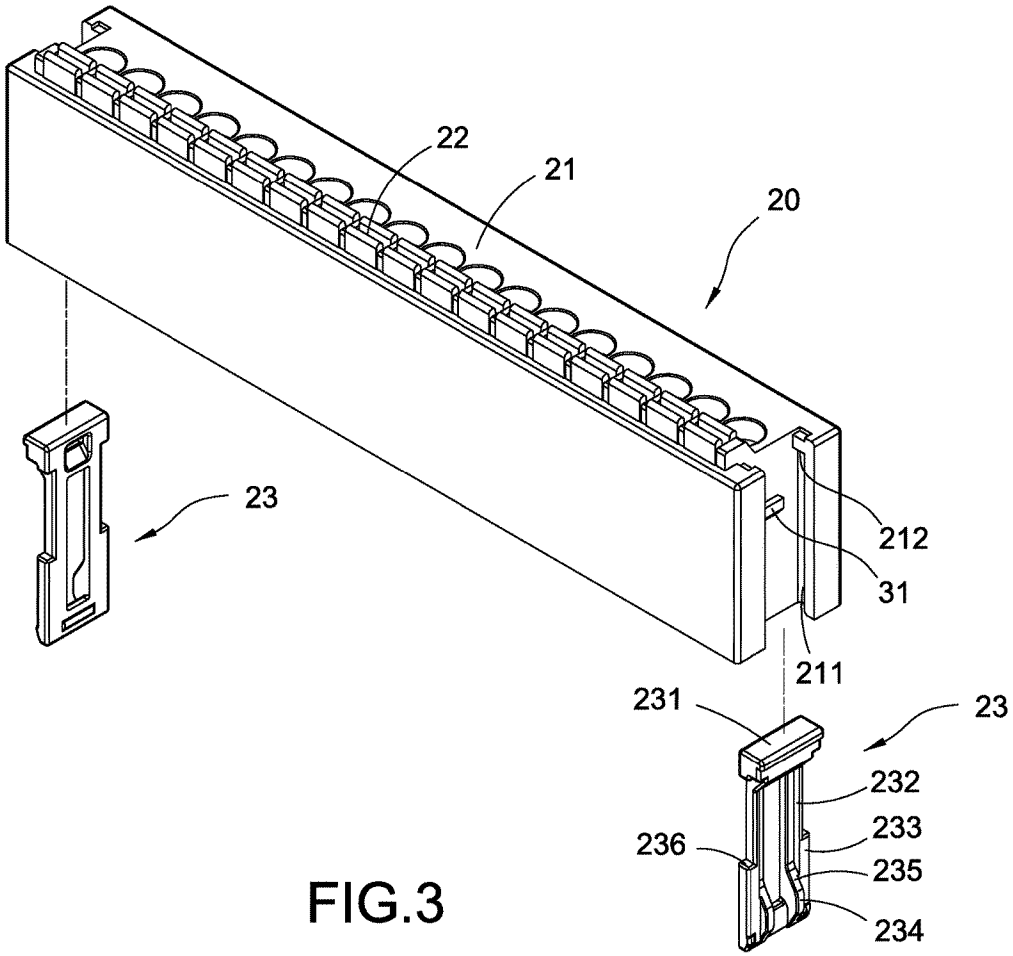
FIG. 3 is a perspective exploded view of the insertion main body and the pull handle of the present invention.
Figure 4:
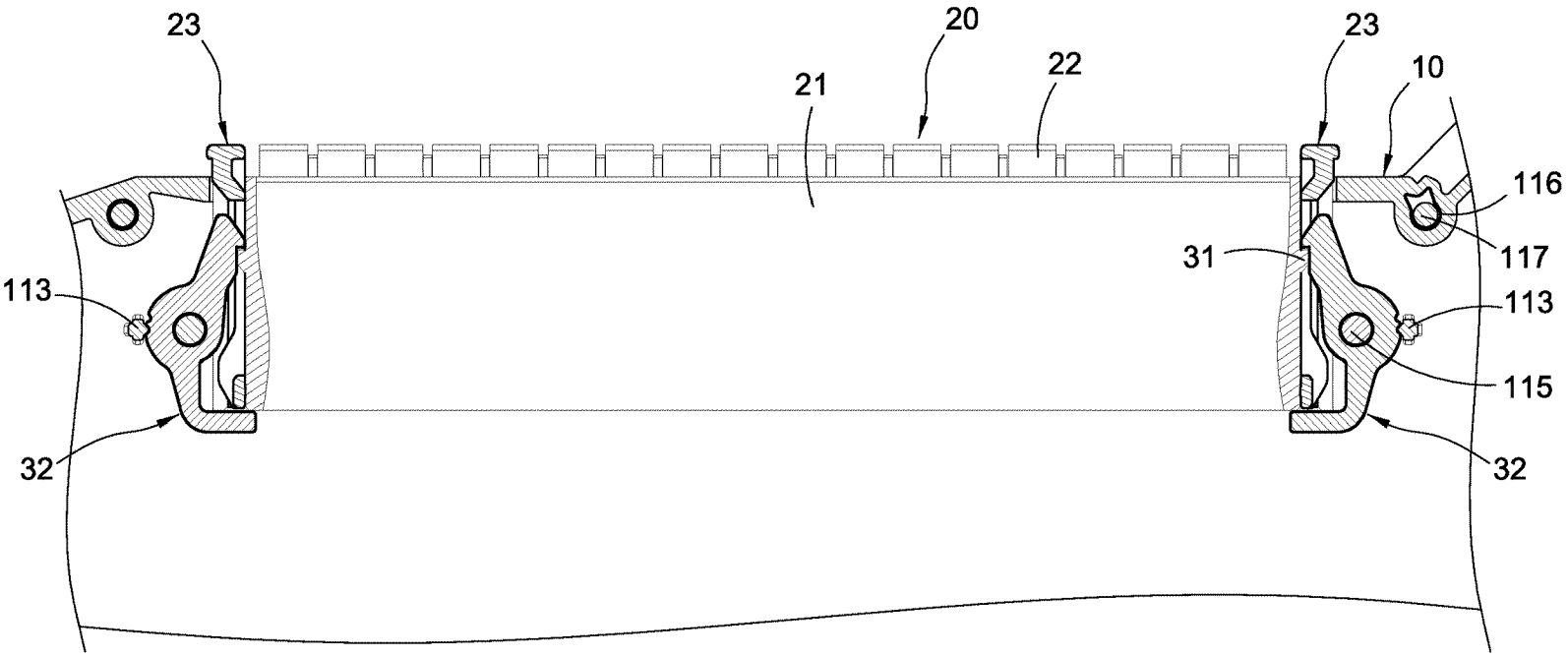
FIG. 4 is an assembly cross sectional view of the connector module of the present invention.
Figure 5:
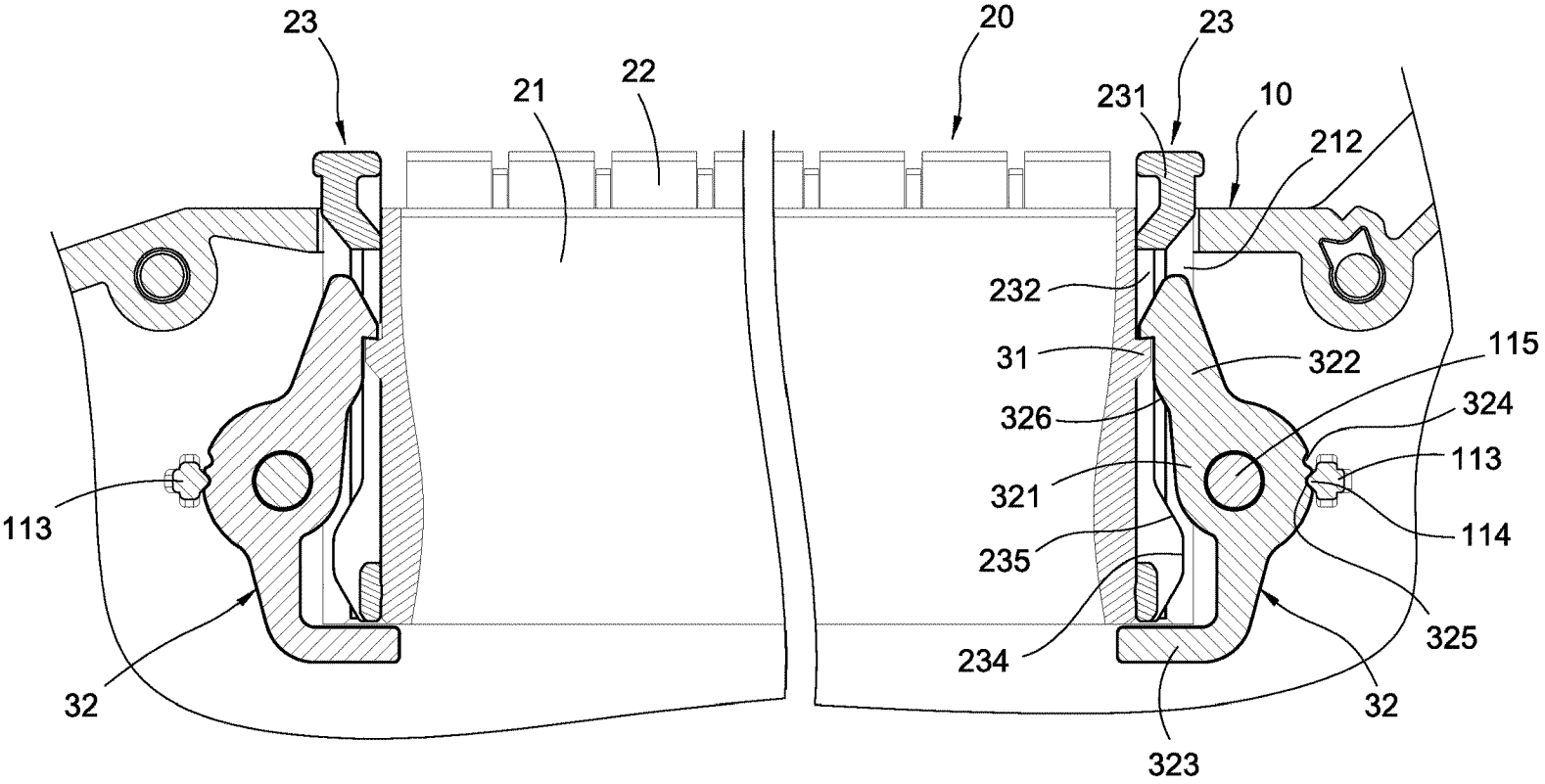
FIG. 5 is a partially enlarged view of FIG. 4.

The following provides a detailed technical content of the present invention along with the accompanied drawings. However, the accompanied drawings are provided for reference and illustrative purpose only such that they shall not be used to limit the scope of the present invention.

As shown in FIG. 1 to FIG. 5, the present invention provides a connector module with a latch structure, which mainly comprises a base 10, a terminal block 20 and a pair of latch structures 30.

The base 10 comprises a housing 11 and other electronic parts (not shown in the drawings) arranged inside the housing 11. In an exemplary embodiment, the housing 11 can be made of an insulative material, and it is generally of a rectangular shape; however, the present invention is not limited to such shape only. The housing 11 mainly comprises a lower housing plate 111 and an upper housing plate 112 assembled with the lower housing plate 111 correspondingly. In addition, an accommodating space A is formed between the upper housing plate 112 and the lower housing plate 111.

The two sides of the accommodating space A of the lower housing plate 111 include a positioning member 113 formed thereon respectively. In an exemplary embodiment, the positioning member 113 is a shaft member. The positioning member 113 includes an insertion shaft 114 formed on one side toward the accommodating space A. In an exemplary embodiment, the insertion shaft 114 has a cross sectional profile of a generally triangular shape. In addition, the inner side of the positioning member 113 at the lower housing plate 111 includes a pivotal attachment axle 115 extended therefrom. Furthermore, the surrounding of the lower housing plate 111 includes a hollow column 116 formed thereon respectively. The surrounding of the upper housing plate 112 includes a protruding column 117 formed thereon and configured to be inserted into each one of the hollow columns 116 correspondingly.

The terminal block 20 is inserted into the aforementioned accommodating space A correspondingly, and it mainly comprises an insertion main body 21 and a plurality of conductive terminals 22 arranged on top of the insertion main body 21.

Furthermore, the terminal block 20 further comprises a pair of pull handle 23. Each pull handle 23 can be moveably attached onto the two corresponding sides of the insertion main body 21. Each side of the insertion main body 21 includes a sliding slot 211 formed thereon respectively. The top end location of the sliding slot 211 includes a retaining plate 212 formed thereon in order to limit the range of movement of the pull handle 23.

Each pull handle 23 mainly comprises a grip 231, two linear rods 232 and two sliding shafts 233. Each linear rod 232 extends downward from the grip 231, and each sliding shaft 233 is respectively formed at an outer side of each linear rod 232. Furthermore, a bottom portion area of each linear rod 232 includes a lifting section 234 formed thereon. The lifting section 234 includes a first slanted surface 235 formed at an area connecting to the linear rod 232. The sliding shaft 233 is slidably attached to the aforementioned sliding slot 211, and the top end of the sliding shaft 233 includes a stopping surface 236 for abutting against the aforementioned retaining plate 212 correspondingly.

Each latch structure 30 is arranged between the housing 11 and the insertion main body 21. Each latch structure 30 mainly comprises a latch portion 31 and a locking member 32. The latch portion 31 is formed at one side of the insertion main body 21 and is formed between the linear rods 232. In an exemplary embodiment, the latch portion 31 is a buckle; however, the present invention is not limited to such configuration only. The locking member 32 is rotatably attached onto the pivotal attachment axle 115 of the housing 11 and is formed at one side of the positioning member 113.

Furthermore, the locking member 32 is generally of an L shape, and it mainly comprises a circular ring 321, a locking portion 322 extended from a perimeter of the circular ring 321 along a tangent line thereof and toward an upward direction as well as an L-shape arm 323 extended from the central axis of the circular ring 321 and toward a downward direction. In an exemplary embodiment, the locking portion 322 is a locking hook; however, the present invention is not limited to such configuration only. The locking portion 322 is locked onto the aforementioned latch portion 31 correspondingly.

Moreover, a perimeter of the circular ring 321 includes a first locking slot 324 and a second locking slot 325 formed thereon and configured to allow the aforementioned positioning member 113 to be positioned selectively. In addition, a second slanted surface 326 is formed between the locking portion 322 and the circular ring 321. The second slanted surface 326 is configured to move operably corresponding to the first slanted surface 235 of the aforementioned lifting section 234.

Figure 6:
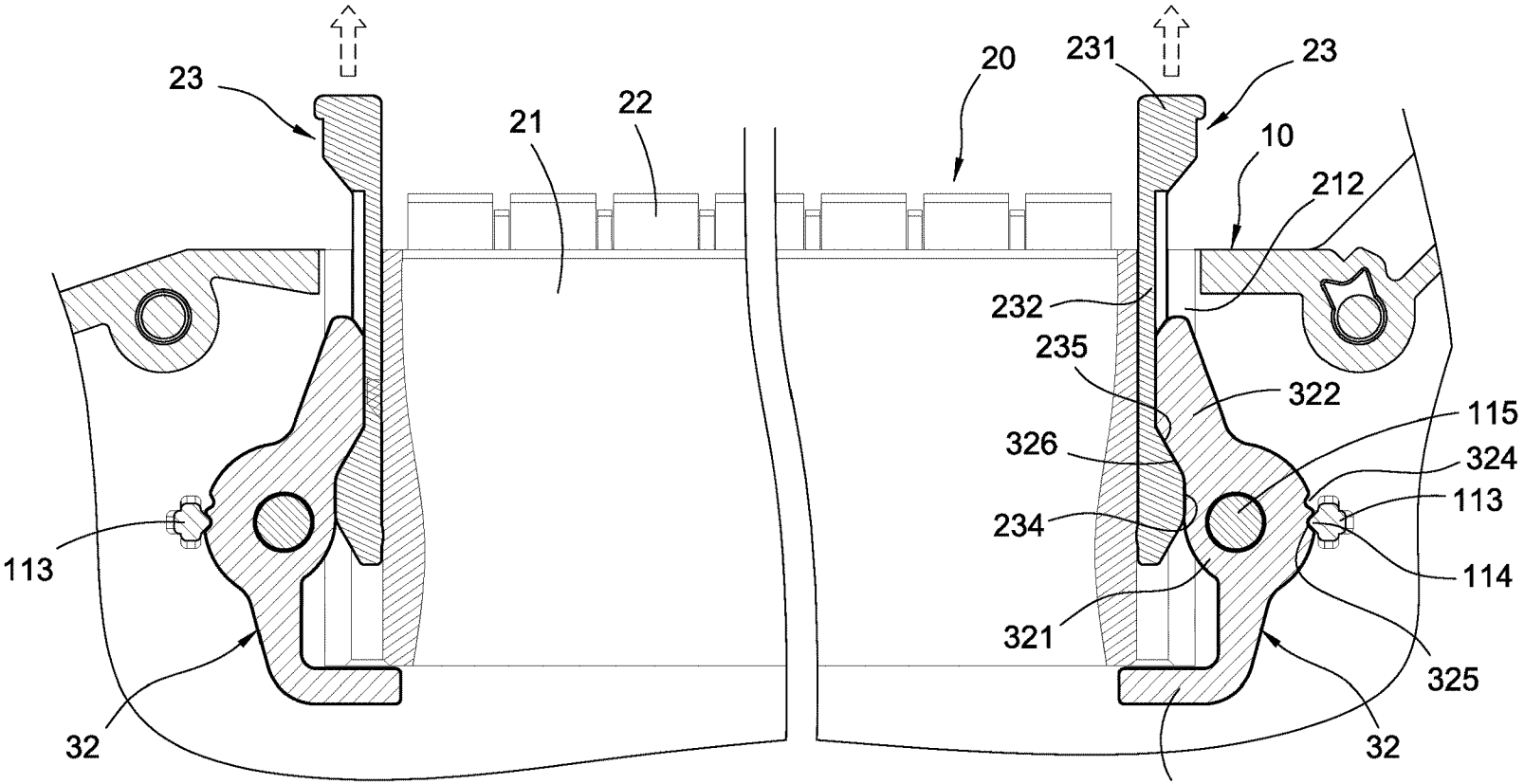
FIG. 6 is a cross sectional view (1) showing a state of use of the connector module of the present invention.
Figure 7:
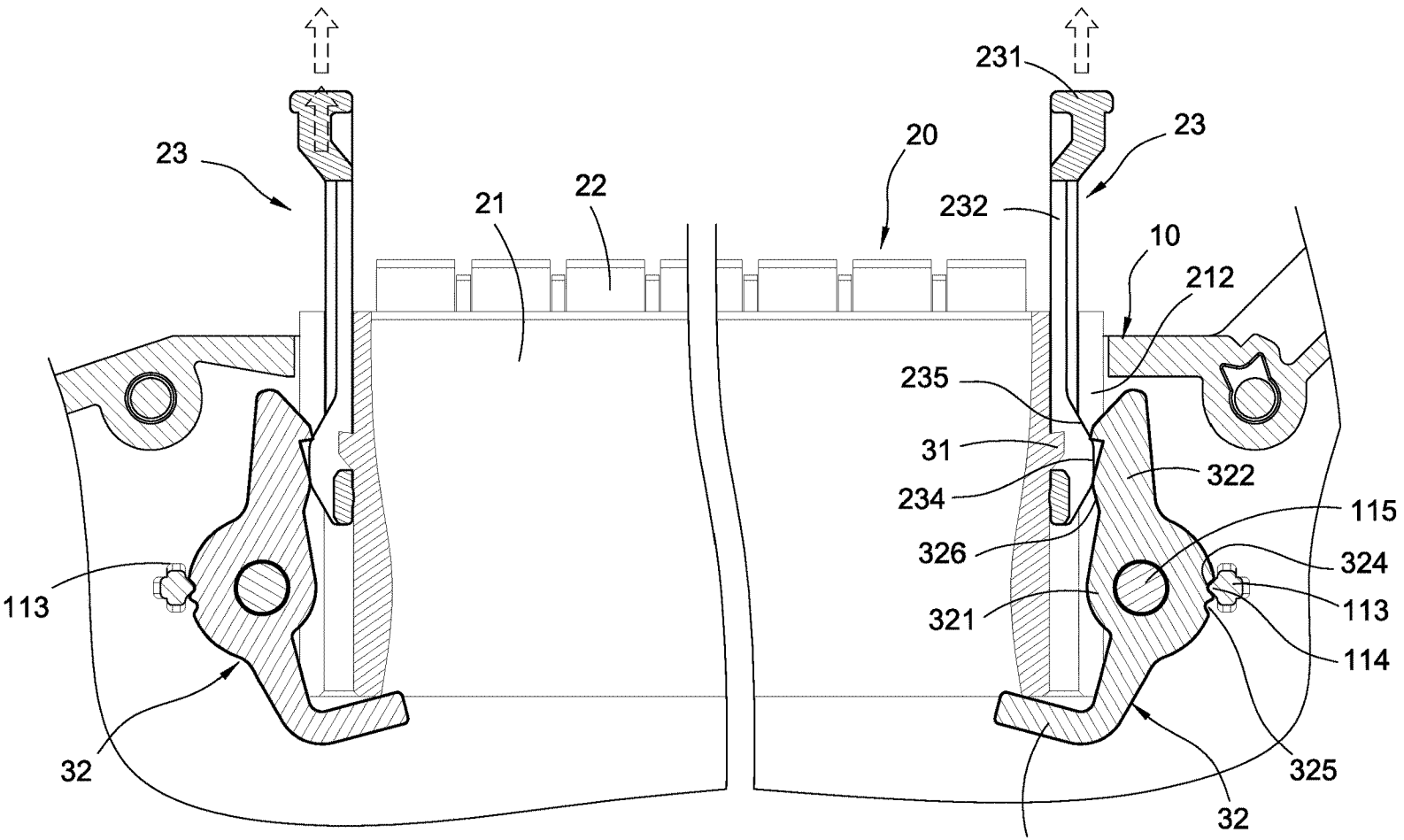
FIG. 7 is a cross sectional view (2) showing another state of use of the connector module of the present invention.
Figure 8:
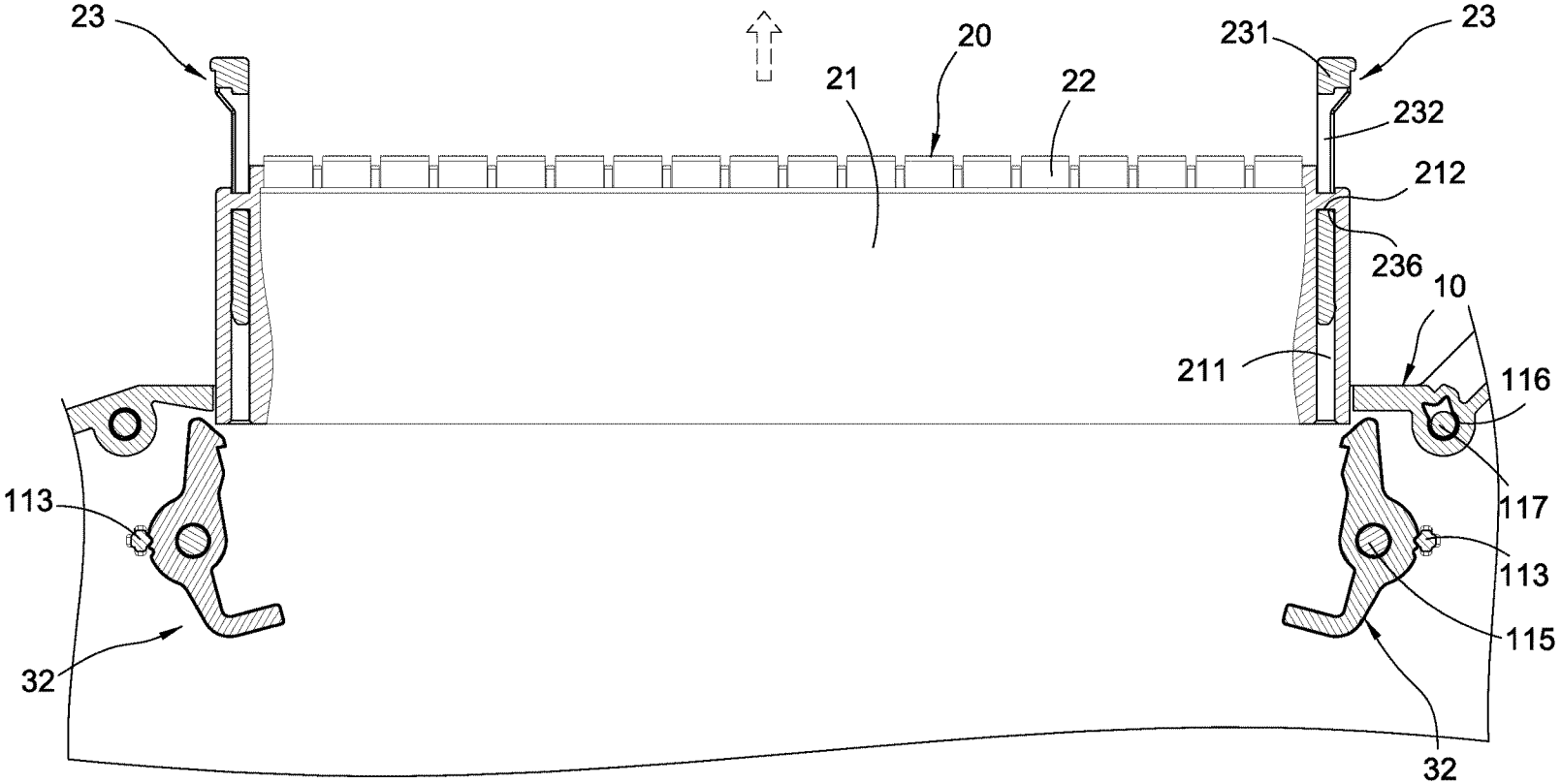
FIG. 8 is a cross sectional view (3) showing still another state of use of the connector module of the present invention.

As shown in FIG. 6 to FIG. 8, during the detachment, the pull handles 23 are lifted upward, and at this time, the sliding shafts 233 move along the sliding slots 211. When the first slanted surface 235 is lifted upward to the position in contact with the second slanted surface 326, the insertion shaft 114 is still inserted inside the second locking slot 325 for positioning (as shown in FIG. 6). Next, when the pull handle 23 is lifted upward, as the first slanted surface 235 pushes the second slanted surface 326, the locking member 32 at the right side is able to rotate in a clockwise direction with the pivotal attachment axle 115 as a rotating center, and the locking member 32 on the left side is able to rotate in a counterclockwise direction with the pivotal attachment axle 115 as a rotating center. At this time, each locking portion 322 is disengaged from each latch portion 31 respectively without locking, and the rotation of the locking member 32 is able to allow the insertion shaft 114 to change to being inserted into the first locking slot 324 for positioning thereon (as shown in FIG. 7). Finally, when the pull handles 23 are lifted upward continuously, the stopping surface 236 of each sliding shaft 233 is able to abut against the retaining plate 212 (as shown in FIG. 8); consequently, the insertion main body 21 can be removed along with the pull handles 23. As a result, under the condition where no additional hand tool is used, the terminal block 20 can be removed from the base 10 easily, and the convenience and practicality of the use of the present invention are improved.

Moreover, after the terminal block 20 is removed from the base 10, the insertion shaft 114 is inserted into the first locking slot 324 for positioning; consequently, it is able to allow the locking members 32 to be under an inverted opening state such that it is able to facilitate the successful insertion of the terminal block 20 onto the base 10 during the next time of assembly thereof.

In view of the above, the connector module with a latch structure of the present invention is able to achieve the objectives of the present invention and overcome the drawbacks of prior arts. The above describes the preferable and feasible exemplary embodiments of the present invention for illustrative purposes only, which shall not be treated as limitations of the scope of the present invention. Any equivalent changes and modifications made in accordance with the scope of the claims of the present invention shall be considered to be within the scope of the claim of the present invention.

What is claimed is:

1. A connector module with a latch structure, comprising:

a base (10) comprising a housing (11); the housing (11) having an accommodating space (A) arranged therein, and the accommodating space (A) having two sides arranged with a positioning member (113) thereon respectively;

a terminal block (20) inserted into the accommodating space (A) correspondingly; the terminal block (20) comprising an insertion main body (21) and a plurality of conductive terminals (22) arranged on the insertion main body (21); and a pair of latch structures (30) respectively arranged between the housing (11) and the insertion main body (21); each one of the latch structures (30) comprising a latch portion (31) formed on the insertion main body (21) and a locking member (32) rotatably connected to the housing (11) and formed on one side of the positioning member (113); the locking member (32) having a locking portion (322) configured to lock onto the latch portion (31) correspondingly and at least one locking slot (324) provided for the positioning member (113) to be positioned thereon, wherein an inner side of the positioning member (113) of the housing (11) includes a pivotal attachment axle (115) extended therefrom; the locking member (32) further comprises a circular ring (321); the locking member (32) is rotatably attached onto the pivotal attachment axle (115) via the circular ring (321).

2. The connector module with a latch structure according to claim 1, wherein the positioning member (113) includes an insertion shaft (114) formed on one side thereon and facing toward the accommodating space (A); the insertion shaft (114) is arranged corresponding to the at least one locking slot (324) for insertion and positioning thereon.

3. The connector module with a latch structure according to claim 2, wherein the insertion shaft (114) has a cross sectional profile of a triangular shape. (321).

4. The connector module with a latch structure according to claim 1, wherein the locking portion (322) is configured to extend from a perimeter of the circular ring (321) along a tangent line thereof and toward an upward direction.

5. The connector module with a latch structure according to claim 4, wherein the locking member (32) further comprises an L-shape arm (323) extended from a central axis of the circular ring (321) and toward a downward direction.

6. The connector module with a latch structure according to claim 1, wherein the at least one locking slot further comprises a first locking slot (324) and a second locking slot (325) formed at the circular ring (321); the positioning member (113) includes an insertion shaft (114) formed thereon; the insertion shaft (114) is configured to be operably inserted into one of the first locking slot (324) and the second locking slot (325) correspondingly for positioning thereon.

7. The connector module with a latch structure according to claim 1, wherein the terminal block (20) further comprises a pair of pull handles (23); the pull handles (23) are configured to moveably attach onto two corresponding sides the insertion main body (21) respectively.

8. The connector module with a latch structure according to claim 7, wherein the insertion main body (21) includes a sliding slot (211) formed on one side thereof; the pull handle (23) comprises a pair of sliding shafts (233), and each one of the sliding shafts (233) is slidably connected to the sliding slot (211) correspondingly.

9. The connector module with a latch structure according to claim 8, wherein the insertion main body (21) at a top end of the sliding slot (211) includes a retaining plate (212), and a top end of each one of the sliding shafts (233) include a stopping surface (236) for abutting against the retaining plate (212) correspondingly.

10. The connector module with a latch structure according to claim 8, wherein the pull handle (23) further comprises a grip (231) and two linear rods (232); each one of the linear rods (232) extends downward from the grip (231), and each one of the sliding shafts (233) is formed at an outer side of the each one of the linear rods (232).

11. The connector module with a latch structure according to claim 10, wherein a bottom portion of each one of the linear rods (232) includes a lifting section (234) formed thereon respectively; the lifting section (234) includes a first slanted surface (235) formed at an area connecting to the linear rod (232); second slanted surface (326) is formed between the locking portion (322) and the circular ring (321); the second slanted surface (326) is configured to move operably corresponding to the first slanted surface (235).

* * * * *